US006513585B2

(12) United States Patent
Brost et al.

(10) Patent No.: US 6,513,585 B2
(45) Date of Patent: Feb. 4, 2003

(54) HEADER-LESS VEHICLE RADIATOR

(75) Inventors: Viktor Brost, Aichtal (DE); Bernhard Lamich, Esslingen (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/821,214

(22) Filed: Mar. 29, 2001

(65) Prior Publication Data

US 2001/0047863 A1 Dec. 6, 2001

(30) Foreign Application Priority Data

Mar. 31, 2000 (DE) ..... 100 16 113
Jul. 7, 2000 (DE) ..... 100 33 070

(51) Int. Cl.[7] ..... F28F 9/04

(52) U.S. Cl. ..... 165/175; 165/177; 165/173; 29/890.052; 29/890.053

(58) Field of Search ..... 165/148, 173, 165/175, 177; 29/890.052

(56) References Cited

U.S. PATENT DOCUMENTS 5,186,250 A * 2/1993 Ouchi et al. ..... 165/177
6,311,768 B1 * 11/2001 Jamison et al. ..... 165/173

FOREIGN PATENT DOCUMENTS

| | | |
|---|---|---|
| CH | 378353 | 7/1964 |
| DE | 3725602 | 2/1989 |
| DE | 3834822 | 4/1990 |
| DE | 19510283 | 9/1996 |
| DE | 19543986 | 5/1997 |
| DE | 19722099 | 9/1998 |
| DE | 19722097 | 12/1998 |
| DE | 19820937 | 11/1999 |

OTHER PUBLICATIONS

Kern, Josef: Neue Konstruktion gelöteter Ganz–Aluminium–Kühler für Kfz, In: ATZ—Automobiltechnische Zeitschrift 100, (1998) 9, pp. 670–673.

* cited by examiner

*Primary Examiner*—Allen Flanigan
(74) *Attorney, Agent, or Firm*—Wood, Phillips, Katz, Clark & Mortimer

(57) ABSTRACT

A "header-less" radiator utilizes a radiator core including tubes having end walls which are bifurcated for a short distance from the ends of the tubes and having one or both of the sidewalls in the bifurcated segment of the tube formed outward and adapted to contact and be joined in a fluid tight manner with the sidewall of an adjacent tube in the radiator core. A collecting tank has walls extending partially over the core to a distance beyond the bifurcation of the sidewalls, and joined to the end walls of the tubes in a fluid tight manner, such that the walls of the collecting tank in conjunction with the bifurcated end walls and outwardly formed side walls of the tubes define a common fluid plenum providing fluid communication between the tubes and the collecting tank.

19 Claims, 6 Drawing Sheets

TANK AREA

CORE AREA

TANK AREA

CORE AREA

HEADER-LESS VEHICLE RADIATOR

This patent application claims priority under 35 USC §119 to commonly assigned German patent applications DE 100 33 070.3, filed Jul. 7, 2000, and DE 100 16 113.8, filed on Mar. 31, 2000.

FIELD OF THE INVENTION

This invention relates to heat exchangers, and more particularly to radiators of the type used in vehicles.

BACKGROUND

Many types of engine powered vehicles utilize a heat exchanger, commonly known as a radiator, to dissipate heat from engine coolant fluid to the ambient air. Such radiators often include a radiator core having a plurality of tubes, through which the coolant flows. The tubes are spaced apart from one another by fins which conduct heat away from the tubes, and dissipate the heat to ambient air which is drawn or forced through the fins between the tubes. To facilitate heat transfer and construction of the radiator, the tubes typically have an elongated rectangular cross-section, with long sidewalls extending through the radiator core for contacting the fins, and short end walls joining the two sidewalls of the tubes.

In one venerable construction of such a radiator, the ends of the tubes are fitted into holes in a header plate, and the joint between the outside surface of the tubes and the header plate is sealed by soldering, brazing, or adhesively bonding the outer surface of the tubes to the header plate. A collecting tank is then joined to the header plate in such a manner that the header plate and tank in combination form a fluid tight reservoir or plenum connecting the open ends of the tubes to a common source of coolant fluid. This construction is undesirable because the header plate, and the operation of joining the tubes to the header plate, involve parts and process steps that add cost and reduce reliability. This construction is also undesirable because fluid flowing between the tubes and the reservoir or plenum must make abrupt turns and undergo rapid expansion or contraction.

In another prior radiator construction, the header plate is combined into the collecting tank through the use of a tubular structure for the collecting tank. The ends of the tubes are contoured and formed to fit into slots in the tubular tank structure. The outer surfaces of the tubes are then joined in a fluid tight manner to the tubular tank structure to form a common reservoir or plenum connecting the tubes. While this construction provides improved manufacturability, by combining the header and tank into one part, the transition for fluid flowing between the plenum and the tubes is still more abrupt and torturous than is desirable.

To facilitate fluid flow, the ends of the tubes joining the tubular tank structure have, in some instances, been enlarged by stretching the walls of the tube at the end joining the tubular tank structure. This typically requires the tubes have walls that are undesirably thick, however, so that the walls of the tube at the enlarged end will still have sufficient thickness and strength for reliable service after the wall of the tube is thinned by stretching. The additional wall thickness is undesirable because it inhibits heat transfer, adds weight and cost, and necessitates the use of relatively large corner radii in fabricating the tubes, to avoid cracking of the tube walls during formation of the tubes. The increased corner radii result in larger gaps to be filled during the process of joining the tubes to the tubular tank structure to form a fluid tight construction, thereby making fabrication more difficult and introducing potential points of failure in operation. An example of this construction is disclosed in German Offenlegungsschrift DE 3834822 A1.

In another form of construction, the header plates are eliminated by stretching the end walls of the tubes for a short distance adjacent the end of the tubes to such a degree that the ends of the sidewalls of adjacent tubes extend across the spaces occupied by the fins and into contact with one another. The side wall ends of the adjacent tubes are then joined to one another, to essentially replace the header plates in the first construction described above, and a tank structure is joined to the stretched end walls of the tubes in a fluid tight manner to form the common reservoir or plenum. Such a construction provides advantages by eliminating the need for a separate header plate, and providing a smoother transition for fluid flowing between the tubes and the common plenum, but still suffers from the disadvantages of requiring a thicker tube wall as described above. Examples of this construction are disclosed in German patent application number 195 43 986 A1; German Utility Model No. 1 519 204; and German DE-PS 1 551 448.

What is needed is an improved radiator and method of constructing such an improved radiator that is of essentially "headerless" construction and avoids the problems described above.

SUMMARY

Our invention provides such an improved radiator through the use of a radiator core including tubes having end walls which are bifurcated for a short distance from the end of the tube and having one or both of the sidewalls in the bifurcated segment of the tube formed outward and adapted to contact and be joined in a fluid tight manner with the sidewall of an adjacent tube in the radiator core. A collecting tank has walls extending over the core to a distance beyond the bifurcation of the sidewalls, and joined to the end walls of the tubes in a fluid tight manner, such that the walls of the collecting tank in conjunction with the bifurcated end walls and outwardly formed sidewalls of the tubes define a common fluid plenum providing fluid communication between the tubes and the collecting tank.

Our invention thus eliminates the need for a separate header plate and provides an improved transition for fluid flowing between the collecting tank and the tubes without the need for stretching the end walls of the tubes. In our radiator, the walls of the collecting tank perform the function provided by the stretched end walls of prior radiator structures. The tubes in our radiators can thus have thinner walls for improved heat transfer and reduced cost and weight. We can utilize tighter bend radii without fear of introducing cracks in the corners of the tubes, and facilitate manufacture of the radiator by reducing the size of gaps between the tubes and adjoining structures in prior radiator constructions. We also achieve a direct reduction in weight and material cost because the redundant function provided by the combined thickness of the stretched tube end walls and the walls of the collecting tank or other structure attached to the stretched end walls is eliminated.

In one form of our invention, the tubes are formed by joining together a first and a second tube half which mate at the end walls to form each tube. In some embodiments of this form of our invention, the first and second tube halves are fabricated to form a generally U-shaped cross section, with the outward projecting legs of the U forming part of the end walls and being joined by one of the side walls of the tube. In some forms of our invention, the legs of each tube half are formed by a simple right angle bend from the side wall of that tube half. The ends of the respective legs of the first and second tube halves are then butted together and bonded to form the end walls of the tube. In other forms, the legs of the first and second tube halves include several bends, which are preferably configured in a complimentary fashion so that the legs of the first and second tube halves will engage each other to facilitate fixturing during manufacture.

In some forms of our invention, the ends of the tubes will be formed prior to welding the intersection of the first and second tube halves. The welded and formed tubes are then assembled with the fins in an interleaved fashion, and joined together by a process such as brazing to form a radiator core, to which one or more collecting tanks are subsequently joined to complete fabrication of the radiator.

In other forms of our invention, the tubes, or the tube halves, the fins, and one or more collecting tanks are assembled in a braze fixture and simultaneously brazed together in a single operation.

In some embodiments of our invention, only one sidewall of each tube will be formed to contact the sidewall of an adjacent tube. In other embodiments, both sidewalls will be formed. Our invention contemplates alternate methods of forming the sidewalls of the tubes. The sidewalls can be formed during fabrication of a tube half, after the tubes are fabricated but not yet assembled into the radiator core, or after the tubes are assembled into the core, as may be required or preferred by those constructing a radiator according to our invention.

These and other forms, aspects, advantages, and novel features of our invention will be readily apparent upon consideration of the following drawings and detailed description of exemplary and preferred embodiments.

DETAILED DESCRIPTION

Figure 1:
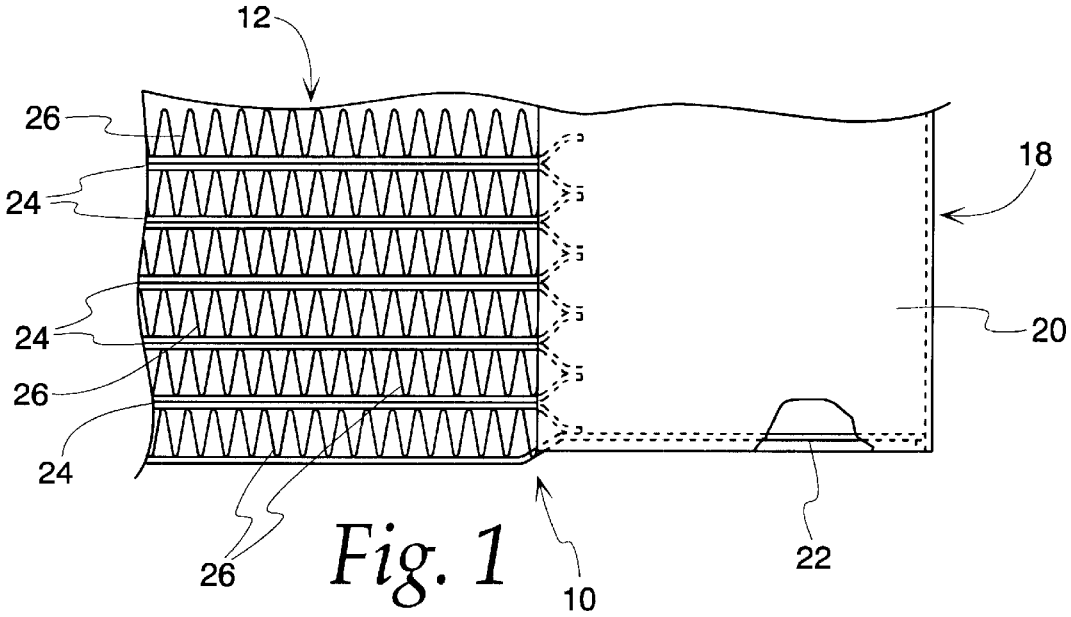
FIG. 1 is a partial sectional view of an exemplary embodiment of a radiator according to our invention.

FIG. 1 depicts an exemplary embodiment of our invention in the form of a radiator 10 for a vehicle. The radiator 10 includes a radiator core 12, and a pair of collecting tanks 18 (only one is shown) each having a generally U-shaped body 20 and end plates 22.

Figure 2A:
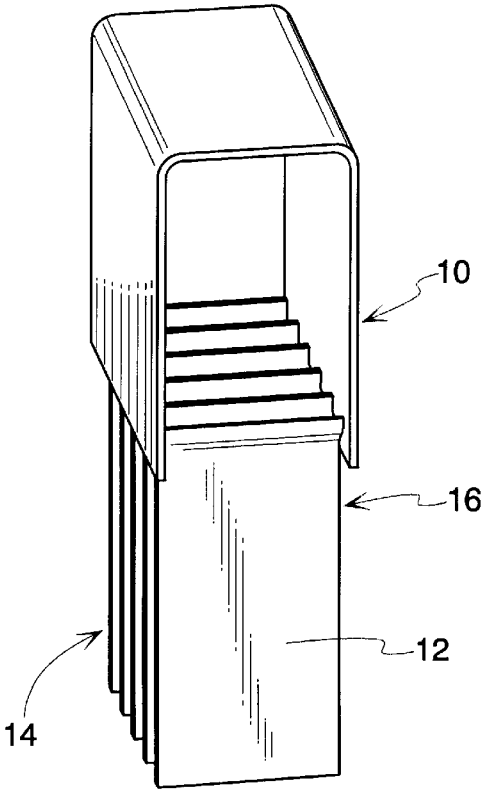
FIGS. 2*a–b* are partial isometrics of the radiator of FIG. 1.
Figure 2B:
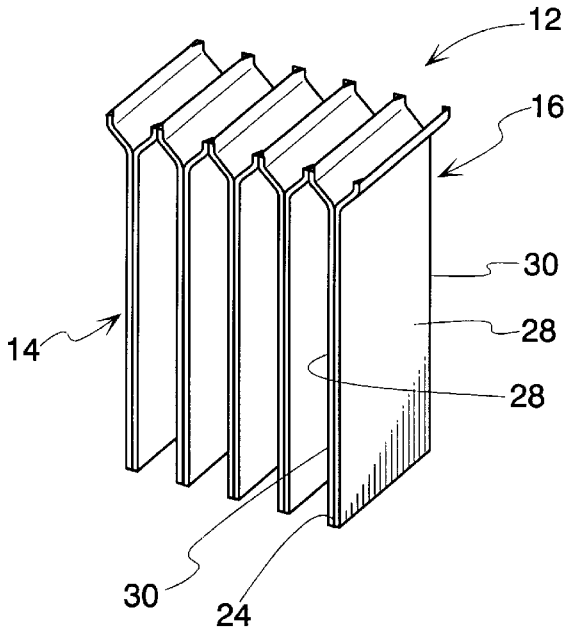

The radiator core 12 defines a front face 14 and rear face 16 thereof, as shown in FIG. 2*a*, and includes a plurality of tubes 24 interleaved with layers of serpentine fins 26 which allow passage of air through the core 12.

Figure 3B:
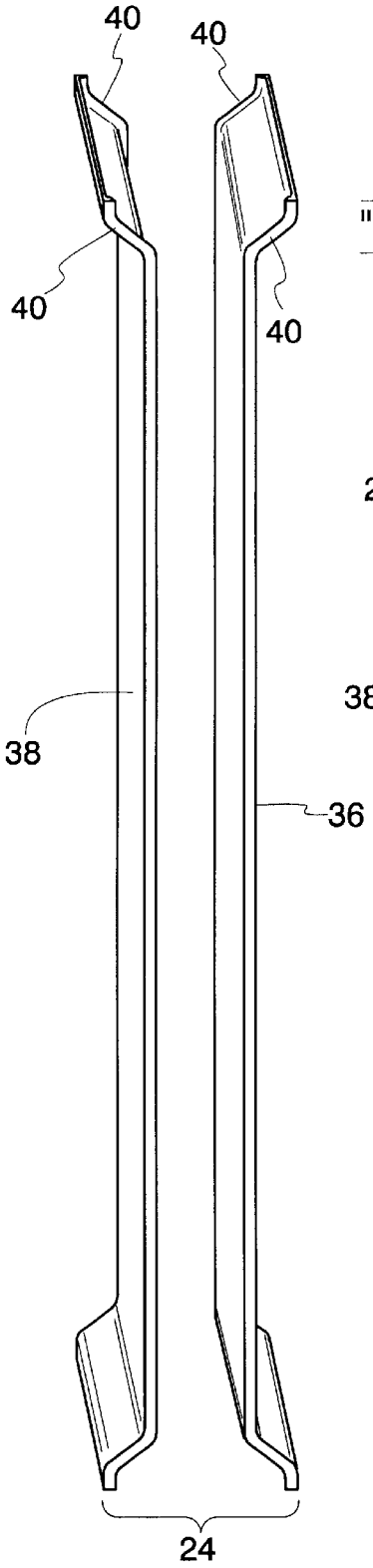
FIGS. 3*a–e* are isometrics of a tube according to our invention.
Figure 3A:
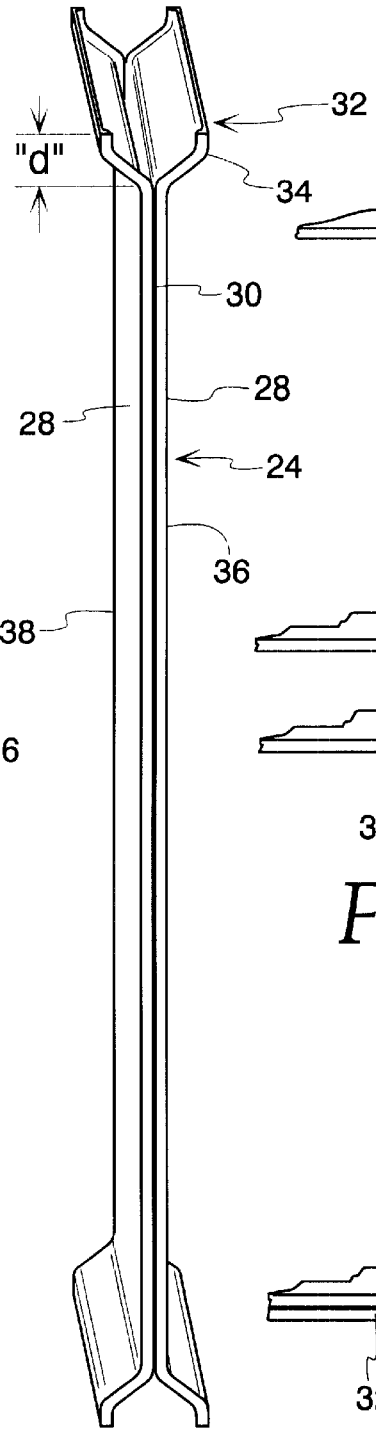
Figure 3C:
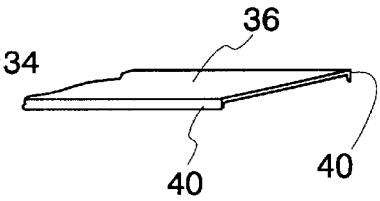
Figure 3D:
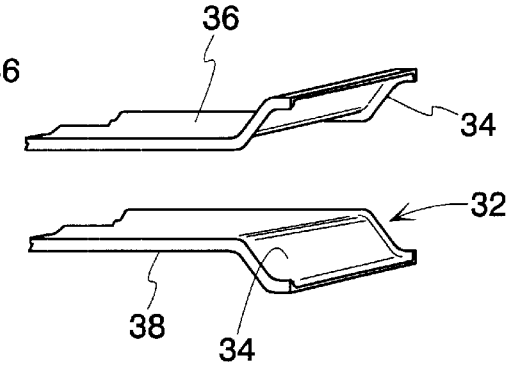
Figure 3E:
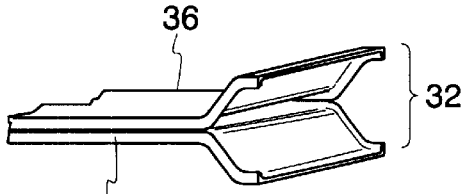
Figure 4:
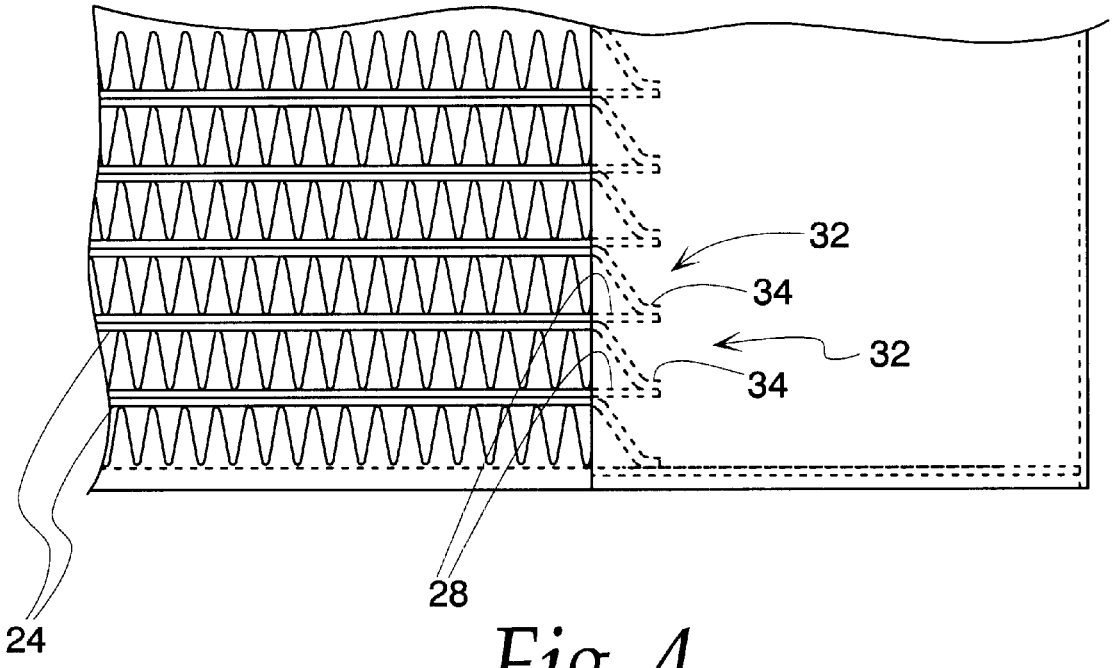
FIG. 4 is a partial sectional view of an alternate embodiment of a radiator according to our invention.

As will be understood by examining FIGS. 1–3*d*, and FIG. 4, the tubes 24 have a generally rectangular cross-section formed by a pair of side walls 28 extending through the core 12 joined by a pair of end walls 30, one end wall 30 of the pair being positioned at the front face 14 of the core, and the other at the rear face 16 of the core 12. The tubes 24 terminate at one or both ends thereof in a formed segment 32 in which the end walls 30 are bifurcated for a distance "d" from the end of the tube 24, and one or both of the side walls 28 is adapted to extend over an end of the fin 26 and contact a sidewall 28 of an adjacent tube 24 in the core 12. FIGS. 1–3*e* depict a form of our invention in which both sidewalls 28 in the formed segment 32 of each tube 24 are adapted by forming them outward in wing-like fashion to provide an adapted sidewall 34 extending halfway across an adjacent layer of fins 26, and into contact with the wing-like adapted sidewall 34 of the formed segment 32 of an adjacent tube 24 when the tubes 24 are assembled into the core 12. FIG. 4 depicts a form of our invention in which only one of the side walls 28 in the formed segment 32 of each of the tubes 24 in the radiator core 12 is adapted by forming it outward in a wing-like fashion to provide an adapted sidewall 34 extending completely across an adjacent end of the fin 26, and into contact with the straight sidewall 28 of an adjacent tube 24.

The tubes 24 and fins 26 are joined together, and the adapted side walls 34 in the formed segments 32 of the tubes are joined in a fluid tight manner to the contacted sidewall 28 of the adjacent tube 24. As used herein, the term "joined in a fluid tight manner" includes but is not limited to joining by welding, brazing, soldering, swaging, and adhesive bonding.

The legs of the U-shaped body 20 of the collecting tank 18 extend over the front and rear faces 14,16 of the radiator core 12, for a distance longer than the distance "d" of bifurcation of the end walls 30 and are joined in a fluid tight manner to the end walls 30 of the tubes 24 throughout and beyond the bifurcation distance "d." The end plates 22 of the collecting tank 18 are joined in a fluid tight manner to the U-shaped body 20 of the collecting tank 18, and to a side wall 28 of the end tube 24 in the core 12, to form a common plenum providing fluid communication between the tubes 24 and the collecting tank 18.

The bifurcated end wall 30 in the formed segment 32 of the tube 24 allows adaptation of the end of the tube 24, as described above, without locally stretching (expanding) and thinning the end wall as is required in prior radiator designs.

In one exemplary form of our invention a header-less radiator 10 as described above is manufactured by a method including the steps of:

fabricating a plurality of tubes 24, each having a generally rectangular cross section comprised of a pair of spaced side walls 28 joined by a pair of end walls 30;

adapting one end of each of the tubes 24 to provide a formed segment 32 having end walls 30 that are bifurcated for a distance "d" from one end of the tubes 30, and at least one adapted side wall 34 in the formed segment 32 adapted to contact and seal against a sidewall 28 of an adjacent tube 24 when the tubes 24 are joined together in an interleaved configuration with layers of fin 26 to form a radiator core 12;

assembling a radiator core 12 in a manner defining a front and a rear face 14,16 thereof and including the plurality of the generally rectangular shaped tubes 24 interleaved with layers of fins 26 for passage of air through the core 12; with the sidewalls 28 of the tubes 24 extending through the core 12, and the end walls 30 positioned at the front and rear faces 14,16 of the core 12; and with the adapted side walls 34 in the formed segments 32 of the tubes 24 contacting a sidewall 28 of an adjacent tube 24 in the core 30;

joining each adapted side wall 34 in the formed segments 32 in a fluid tight manner to the contacted side wall 28 of an adjacent tube 24;

attaching a collecting tank 18 with walls thereof extending over the front and rear faces 14,16 of the core 12, past the bifurcation of the end walls 30 of the tubes 24; and joining the collecting tank 18 in a fluid tight manner to the end walls 30 of the tubes 24 along and beyond the bifurcation, to thereby form a fluid tight joint between the walls of the collecting tank 18 and the end walls 30 of the tubes 24.

We contemplate that fabrication of the tubes 24 and the step of adapting the end of the tubes 24 can be accomplished by a number of alternative methods, suitable to various materials and manufacturing or operating environments.

Figure 5A:
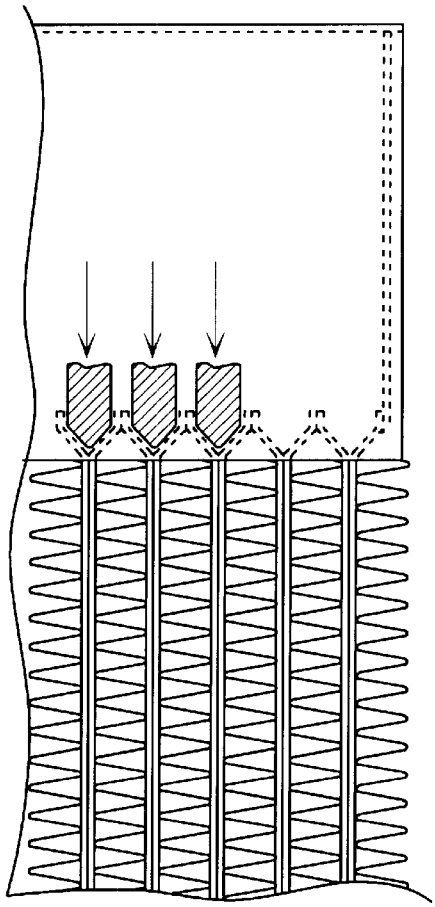
FIGS. 5*a–b* depict a method of forming adapted sidewalls on tubes in a radiator according to our invention.
Figure 5B:
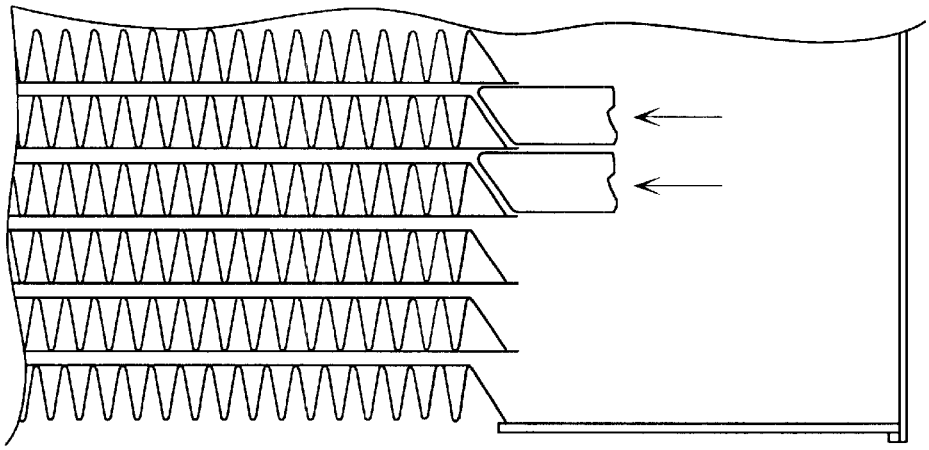

For example, the end walls 30 of an extruded seamless tube 24 can be machined to include a slit extending from the end of the tube 24 a distance "d" to form the bifurcated segment of the end walls 30. One or both of the side walls 28 in the bifurcated segment can then be bent outward to form an adapted side wall 34. In some instances it may be desirable to complete the step of adapting the ends of the tubes 24 after the core is assembled by forcing a forming tool or fixture 44 into the bifurcated ends of the tubes 24, as illustrated in FIGS. 5*a–b*. In other instances, it may also be desirable to perform the step of machining the sidewalls 30 to form the bifurcation after the core 12 is assembled.

Alternatively, the tubes 24 can be fabricated as shown in FIGS. 3*a–*3*e*, by forming a first and a second tube half 36,38 each being generally U-shaped with a pair of legs 40 extending in a generally perpendicular direction from one of the side walls 36,38. The legs 40 form part of each end wall 30 of the tube 24. The legs 40 of the first and second tube halves 36,38 are then butted against one another as shown in FIG. 3*a*, and joined along the abutting surfaces 42 by a fluid tight process, such as welding, or laser welding, to complete formation of the end walls 30 and the tube 24. The two halves may be left unjoined for a distance "d" at the end of the tube to form the bifurcated segment of the end walls 30.

The step of forming the adapted sidewall 34 can be performed after the first and second tube halves 36,38 are joined together, and either prior to, or after assembly of the core 12 as described above. Alternatively the adapted sidewalls 34 can be formed prior to joining the tube halves 36,38 together by bending either or both of the first and second tube halves 36,38, as shown in FIGS. 3*b* and 3*d*.

In some instances it may be desirable to delay joining the tube halves 36,38 together until after the core 12 is assembled. This can be particularly advantageous when it is desired to join all of the parts of the core12 or the radiator 10 together in a single process step, for example by constructing the parts of the core 12 or radiator from aluminum coated with a layer of braze material and brazing the entire assembly together simultaneously.

The tube halves 36,38 can be formed by bending both edges of a flat strip upward or downward to an angle substantially perpendicular to the flat strip, as shown in FIG. 3*c*, to form a tube half 36, 38 with the bent edges comprising part of the end walls 30 and the remainder of the flat strip between the bent edges comprising one of the side walls 28 of the tube 24. In some instances it may be desirable to bend the edges of the flat strip multiple times to form folded partial end walls 30 on the tube halves 36,38. Such folded end walls 30 provide reinforcement of the end walls 30, increased contact area for forming a fluid tight joint, and in some forms of our invention are configured such that the tube halves 36,38 interlock along the abutting surfaces 42 to facilitate fixturing and fabrication of the tubes 24 and/or the core 12 radiator 10. FIGS. 6*a–h* depict four of the virtually unlimited number of folded edge configurations that can be utilized in practicing our invention, and the manner in which the end walls 30 of tubes 24 formed from tube halves 36,38 having those four folded edge configurations mate with the collecting tank 18.

Figure 6A:
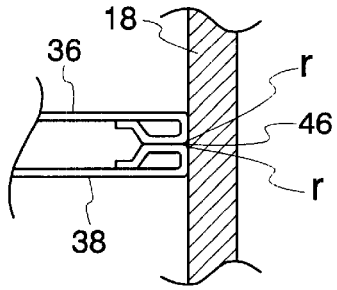
FIGS. 6*a–h* are partial enlarged sectional views of alternate embodiments of tubes according to our invention.
Figure 6C:
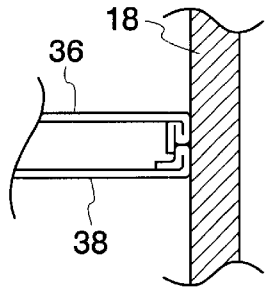
Figure 6B:
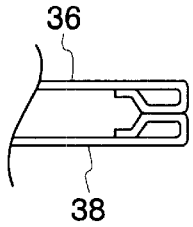
Figure 6D:
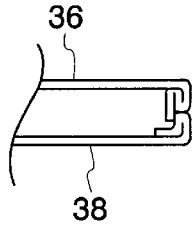
Figure 6E:
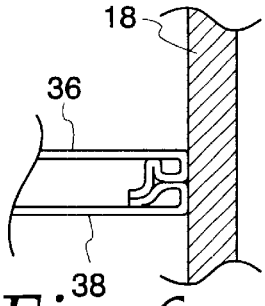
Figure 6F:
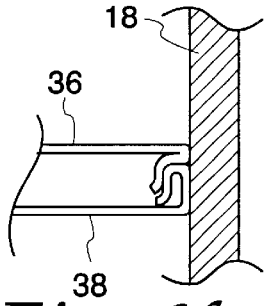
Figure 6G:
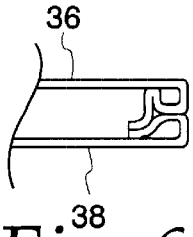
Figure 6H:
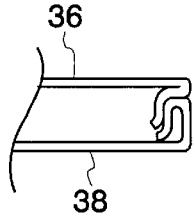

FIG. 6*a* also illustrates an advantage provided by our invention. Because we do not need to accommodate thinning of the end walls of the tubes, as was the case in prior radiators where the end walls were stretched to enlarge the end of the tubes contacting the collecting tank, we can use thinner walls in our tubes, which in turn allows for the use of significantly smaller corner radii "r" in fabricating the tubes. When the radiator is assembled, these smaller corner radii "r" reduce the size of the gaps, as indicated at 46 in FIG. 6*a*, that must be closed to create a fluid-tight joint, thereby facilitating manufacture and increasing strength and reliability of the radiator.

Figure 7:
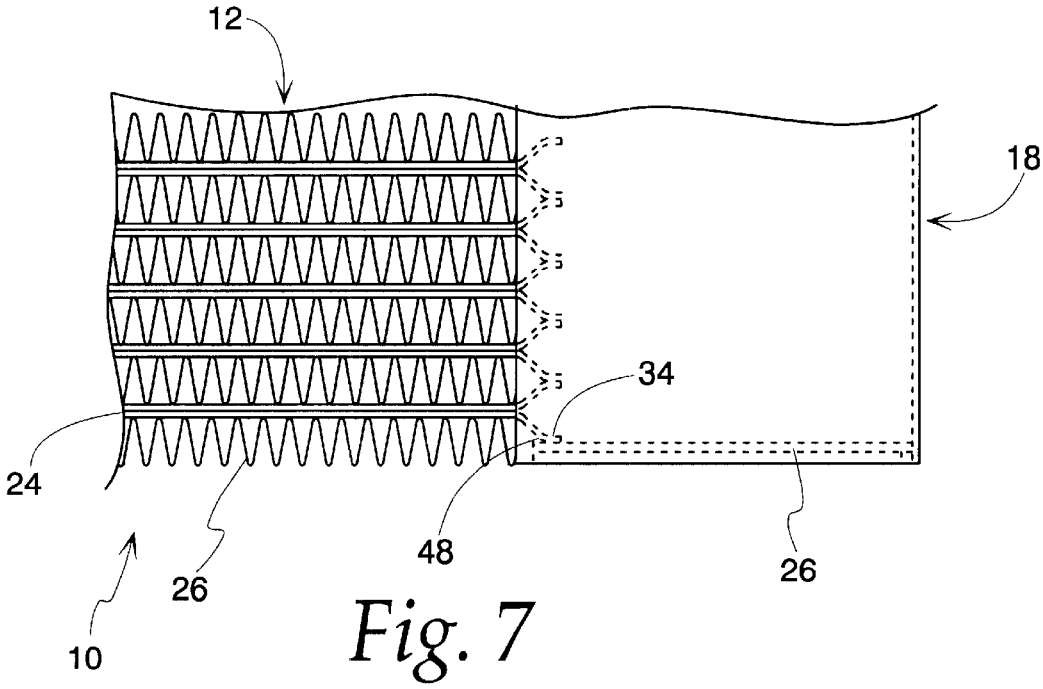
FIGS. 7 and 8 depict additional alternate embodiments of our invention.
Figure 8:
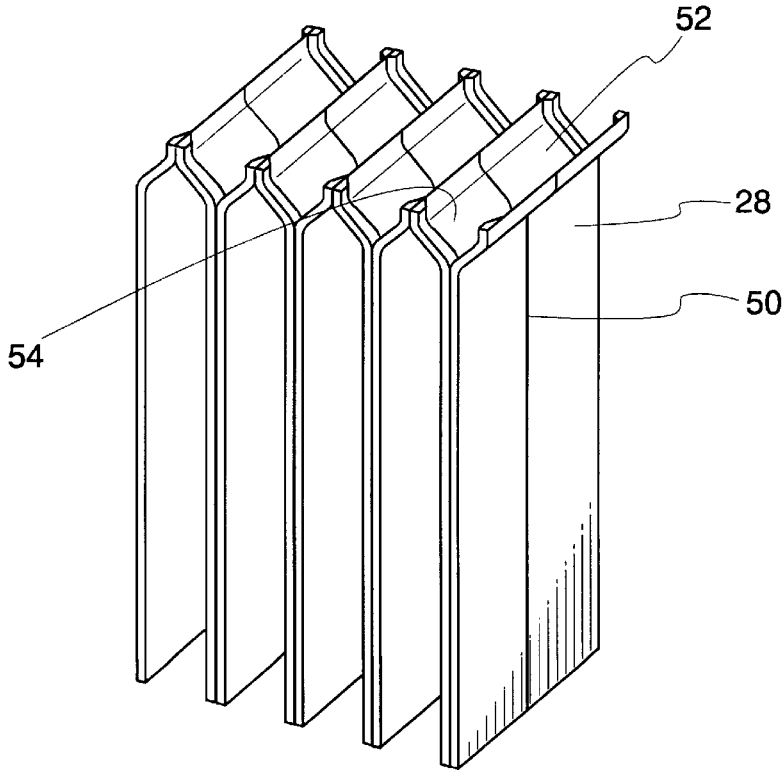

Although we have provided a number of exemplary and preferred embodiments in the preceding discussion, those having skill in the art will recognize that our invention may be practiced in many alternate forms within the scope of the appended claims. For example, the end plates 22 of the collecting tank 18 may not extend along the outermost layer of fin 26, as shown in FIG. 1, but may instead terminate after being joined to the adapted sidewall 34 of the outermost tube 24 in the core 12, as indicated at reference numeral 48 of FIG. 7, leaving the outermost layer of fin 26 exposed at the periphery of the radiator 10. It may also be desirable to add additional stiffening or flow directing ribs 50 extending internally or externally from the side walls 28 of the tubes 24, as shown in FIG. 8. The ability to fabricate the tubes in our radiator in two halves makes it a simple matter to form such ribs 50 by bending or embossing the sidewalls of the tubes.

Our invention may also be used with different collecting tank configurations than the forms illustrated in the drawings and description. Our invention be used in a wide variety of alternate core stacking and flow arrangements, and with straight fins, or many types of fins other than the serpentine fins shown in the drawings.

We also wish to expressly state that, although the exemplary embodiments described above and in the appended claims make detailed reference to the structure and method of forming the tubes and other component parts at one end of a radiator core, we contemplate that in other forms of our invention within the scope of the claims, it may be desirable to utilize a similar structure and/or construction method at more than one end of the tubes, or the radiator core.

It is understood, therefore, that the spirit and scope of the appended claims should not be limited to the specific embodiments described and depicted herein.

We claim:

1. A radiator comprising:

a radiator core defining a front and a rear face thereof and including a plurality of generally rectangular shaped tubes interleaved with layers of fins for passage of air through said core; and a collecting tank attached to said core in a fluid tight manner to provide fluid communication between said tubes and said collecting tank;

said tubes each having a pair of side walls extending through said core and joined by end walls at said front and rear face of said core;

said tubes each terminating at one end thereof in a formed segment wherein said end walls of each tube are bifurcated for a distance from said one end of the tube to define planar portions disposed substantially normal to said side walls and one of said side walls is adapted to contact a side wall of an adjacent tube in the core;

said adapted side wall being joined in a fluid tight manner to said contacted side wall of said adjacent tube;

said collecting tank having walls thereof extending over said front and rear faces of said core past said bifurcation of said end walls in substantial surface to surface with said planar portions and joined in a fluid tight manner to said end walls and said planar portions of said tubes along and beyond said bifurcation to thereby form a fluid tight joint between said walls of said collecting tank and said end walls of said tubes.

2. The radiator of claim 1 wherein both sidewalls are adapted to contact an adjacent tube.

3. The radiator of claim 1 wherein each of said tubes has a first tube half and a second tube half, each of said halves being generally U-shaped with, a pair of legs extending in a generally perpendicular direction from one of said side walls to form part of said end walls.

4. The radiator of claim 3 wherein said legs of said pair of tube halves are joined in fluid tight manner along the entirety of said tube except in said formed segment where said legs remain unjoined to form said bifurcation of said end walls.

5. The radiator of claim 1 wherein said end walls include a slit in said formed segment opening to the end of the tube to bifurcate said end wall in said formed segment.

6. The radiator of claim 4 wherein said legs of said tube halves are joined in a fluid tight manner by welding, and said core is formed by brazing said tubes and fins together.

7. The radiator of claim 1 wherein said collecting tank includes a generally U-shaped body having walls of the U-shaped body spaced apart to slide over and simultaneously contact said front and rear faces of said core, said collector tank further including end plates adapted to close in a fluid tight manner an opening defined by an end of said U-shaped body of said collecting tank and a side wall of a tube in said core.

8. A method for fabricating a headerless radiator comprising:

fabricating a plurality of tubes, each having a generally rectangular cross section comprised of a pair of spaced side walls joined by a pair of end walls;

adapting one end of each of said tubes to provide a formed segment having said end walls bifurcated for a distance from said one end to provide planar portions generally normal to said side walls and at least one side wall in said formed segment adapted to contact and seal against a sidewall of an adjacent one of said tubes when said tubes are joined together in an interleaved configuration with layers of fin to form a radiator core;

assembling a radiator core in a manner defining a front and a rear face thereof and including said plurality of generally rectangular shaped tubes interleaved with layers of fins for passage of air through said core; said sidewalls of said tubes extending through said core with said end walls at said front and rear faces of said core; and with said adapted side walls in said formed segments of said tubes contacting a sidewall of an adjacent tube in the core;

joining each said adapted side wall in said formed segments in a fluid tight manner to said contacted side wall of said adjacent tube;

attaching a collecting tank having walls thereof extending over said front and rear faces of said core along and beyond said bifurcation of said end walls and in substantial surface to surface contact with said planar portions; and joining said collecting tank in a fluid tight manner to said end walls and said planar portions of said tubes along and beyond said bifurcation to thereby form a fluid tight joint between said walls of said collecting tank and said end walls of said tubes.

9. The method of claim 8 wherein the step of adapting one end of each of said tubes is carried out after assembling said radiator core.

10. The method of claim 9 wherein the step of adapting includes forming at least one of said sidewalls in said formed segment at said one end of said tubes to contact a sidewall of an adjacent tube in said core by inserting a forming tool into said one end of each of said plurality of tubes.

11. The method of claim 8 wherein the step of fabricating said tubes includes forming each of said tubes from a first and a second tube half, each of said tube halves including one of said side walls and part of both end walls.

12. The method of claim 11 wherein the step of fabricating said tubes further includes joining said first and second tube halves to form said tubes prior to said step of assembling said radiator core.

13. The method of claim 11 wherein the step of adapting is performed on at least one of said tube halves prior to joining the first and second tube halves to form a tube.

14. The method of claim 11 wherein the step of adapting is performed after joining said first and second tube halves to form a tube.

15. The method of claim 11 wherein the step of fabricating said tubes includes forming said tube halves into a generally U-shaped configuration by bending both edges of a flat strip to an angle substantially perpendicular to said flat strip, said edges thereafter comprising said parts of said end walls and said flat strip between said end walls comprising one of said side walls.

16. A method for fabricating a headerless radiator comprising:

fabricating a plurality of tubes, each having a generally rectangular cross section comprised of a pair of spaced side walls joined by a pair of end walls;

adapting one end of each of said tubes to provide a formed segment having said end walls bifurcated for a distance from said one end and at least one side wall in said formed segment adapted to contact and seal against a sidewall of an adjacent one of said tubes when said tubes are joined together in an interleaved configuration with layers of fin to form a radiator core;

assembling a radiator core in a manner defining a front and a rear face thereof and including said plurality of generally rectangular shaped tubes interleaved with layers of fins for passage of air through said core; said sidewalls of said tubes extending through said core with said end walls at said front and rear faces of said core; and with said adapted side walls in said formed segments of said tubes contacting a sidewall of an adjacent tube in the core;

joining each said adapted side wall in said formed segments in a fluid tight manner to said contacted side wall of said adjacent tube;

attaching a collecting tank having walls thereof extending over said front and rear faces of said core along and beyond said bifurcation of said end walls; and joining said collecting tank in a fluid tight manner to said end walls of said tubes along and beyond said bifurcation to thereby form a fluid tight joint between said walls of said collecting tank and said end walls of said tubes;

said step of fabricating said tubes includes forming each of said tubes from a first and second tube half, each of said tube halves including one of said side walls and part of both end walls and further includes forming said tube halves into a generally U-shaped configuration by bending both edges of a flat strip to an angle substantially perpendicular to said flat strip, said edges thereafter comprising said parts of said end walls and said flat strip between said end walls comprising one of said side walls, and further includes bending said edges multiple times to form end walls of folded configuration.

17. The method of claim 16 wherein the step of fabricating further includes bending edges to form said portions of at least one end wall on each tube half which are configured in a complimentary fashion such that the portions of said at least one end wall on the first and second tube halves will engage and interlock with each other to facilitate fabrication of a tube.

18. The method of claim 8 wherein the step of joining said formed segments in a fluid tight manner to said contacted sidewalls and said step of joining said collecting tank in a fluid tight manner to said end walls of said tubes are performed simultaneously.

19. A heat exchanger comprising:

a core having opposite front and rear faces and including a plurality of tubes of generally rectangular cross section with fins interleaved between adjacent tubes intermediate opposite ends of the tubes;

said tubes each having a pair of spaced side walls extending generally between said faces, and spaced end walls joining the side walls of each tube and located generally at said faces;

at least one end of each said tube having the end walls thereat split for a distance from one end extending to an intermediate location along a length of the tube to provide planar portions generally normal to said side walls and separated along the split so that at least one side wall, at said tube one end, contacts a side wall of an adjacent tube and is joined thereto in a fluid tight manner; and a collecting tank having walls extending over said front and rear faces of said core and in substantial surface-to-surface contact with and joined in a fluid tight manner to said planar portions of said end walls at said tube one end where said end walls are split and extending to and past said intermediate location to thereby form a fluid tight joint between said tank walls and said end walls from said tube one end to and past said intermediate location.

* * * * *